US006176181B1

(12) United States Patent
Van Ryzin et al.

(10) Patent No.: US 6,176,181 B1
(45) Date of Patent: Jan. 23, 2001

(54) DECK CONFIGURATION FOR A PRINTING PRESS

(75) Inventors: William J. Van Ryzin, DePere; Paul A. Nelson; Roman J. Mudry, both of Green Bay, all of WI (US)

(73) Assignee: Paper Converting Machine Company, WI (US)

( * ) Notice: Under 35 U.S.C. 154(b), the term of this patent shall be extended for 0 days.

(21) Appl. No.: 09/378,022

(22) Filed: Aug. 20, 1999

(51) Int. Cl.[7] ..... B41F 5/18
(52) U.S. Cl. ..... 101/216; 101/178
(58) Field of Search ..... 101/216, 217, 101/219, 212, 178, 174, 171

(56) References Cited

U.S. PATENT DOCUMENTS 2,104,417 * 1/1938 Dolphi et al. ..... 101/178
3,371,598 * 3/1968 Waplan ..... 101/174
5,009,157 * 4/1991 Rogge et al. ..... 101/178
5,370,047 12/1994 Compton ..... 101/216
5,407,708 * 4/1995 Lovin et al. ..... 101/212
5,617,789 * 4/1997 Achelpohl et al. ..... 101/216
5,906,162 5/1999 Kolbe et al. ..... 101/352.01
5,974,968 11/1999 Achelpohl et al. ..... 101/247

OTHER PUBLICATIONS

Flexo & Gravure International, Feb. 1998.
Novoflex Brochure Published by Windmoller & Holscher.
Color copy of p. 12 of Novoflex Brochure.
Converting Today, Dec. 1996.

* cited by examiner

*Primary Examiner*—John S. Hilten
*Assistant Examiner*—Anthony H. Nguyen

(57) ABSTRACT

A deck for a printing press includes first and second rolls which are mounted for linear movement on a pair of spaced parallel rails. A rotatable ball screw moves the rolls along the rails. The axis of the screw substantially intersects the axes of the rolls.

7 Claims, 7 Drawing Sheets

DECK CONFIGURATION FOR A PRINTING PRESS

BACKGROUND

This invention relates to printing presses, and, more particularly, to a deck configuration for a printing press.

Printing presses such as flexographic presses include one or more decks for supporting rolls adjacent a central impression (CI) drum or cylinder. For example, a flexographic press typically includes multiple color decks, and each color deck includes a plate roll and an anilox roll. The anilox roll transfers ink from an ink fountain to the plate roll. The plate roll carries the print image and imprints the image onto a web which is supported by the central impression (CI) drum. The plate roll and anilox roll of each deck are mounted for movement toward (racked in position) and away (racked out position) from the CI drum.

A deck design which is currently being offered by Paper Converting Machine Company, the assignee of this invention, uses a set of linear bearings mounted on a linear rail on each of the front and rear frames of the press. The plate and anilox rolls are mounted on top of the linear bearings and are moved along the linear rails by a ball screw.

Forces which are generated in the printing nip between the CI drum and the plate roll are transferred to the printing deck through the bearings which support the journals of the plate and anilox rolls. The configuration results in a moment load byproduct that must be absorbed by the linear bearings as the ball screw absorbs the linear forces from the printing nip. Linear bearings, although capable of supporting modest moment loads, are generally not intended for robust support of moment loads. The net effect is that relatively significant deflections can be incurred from modest nip forces due to the linear bearings rocking on the linear rails.

As the line of action of the axis of the plate and/or anilox rolls moves away from the rotational axis of the CI drum, the nip forces transmitted to the deck have a higher impact on the deflection of the deck components. These deflections ultimately compromise the quality of the printing that can be achieved, primarily from susceptibility to bounce.

The problem with the present art is the moments that are applied to the color deck components because of their configuration. In the present configuration, the ball screw and plate/anilox rolls are not mounted in-line with each other. During normal printing conditions, a force is applied to the plate/anilox rolls and is then transmitted to the other color deck components. The ball screw is the only component that resists a horizontal load, so a moment is created because the plate/anilox rolls are mounted above the ball screw. The larger the vertical distance between the ball screw and the plate/anilox rolls, the larger the moment.

The linear bearings are the only component that can resist the moment load, but because of the limited distance the runner blocks can be spaced apart, high moment loads result in large plate/anilox roll deflections. The moment loads are undesirable for horizontal decks and are amplified for angled decks. As a result of the moments applied due to the prior art configuration, all of the color deck components rotate as printing forces are applied. The net result from this deck design is lowered deck stiffness (spring elements in series) and higher susceptibility to bounce during printing.

SUMMARY OF THE INVENTION

The invention eliminates the moment loading condition by placing the ball screw along the line of action of the plate/anilox rolls. This configuration absorbs the full line of action component of the nip forces. The perpendicular components of the nip forces are subsequently absorbed by the linear bearings in such a way as to use the primary utility of the linear bearing mechanism.

Another feature of the invention is the addition of a second linear rail so that the ball screw resides vertically between the two linear rails. By placing linear bearings above and below the ball screw, a much wider stance is achieved, thereby providing a much stiffer deck configuration.

The invention also minimizes the detrimental effect of orienting the decks away from the optimal orientation of having the line of action of the anilox/plate roll intersecting the rotational axis of the CI drum. The print load is shared between the ball screw and the linear bearings on all decks except where the line of action of the plate/anilox rolls intersects the rotational axis of the CI drum. In the latter case, the ball screw is sized sufficiently (for all decks) to be able to handle column loading, and the linear rails only provide a means of guiding the plate/anilox rolls.

The invention provides a number of benefits. The printer is given a stiffer deck, i.e., a print station that moves less when impacted by the print loading. The press design is given the advantage of using smaller, less costly components in the press deck area to achieve the required deck stiffness. The invention can be used on geared presses as well as gearless presses.

DESCRIPTION OF THE DRAWING

The invention will be described in conjunction with an illustrative embodiment shown in the accompanying drawing, in which.

DESCRIPTION OF SPECIFIC EMBODIMENT

The invention will be explained in conjunction with a flexographic printing press which includes multiple print decks. However, it will be understood that the invention can also be used with other types of presses and can be used on presses which have only one print deck.

Figure 1:
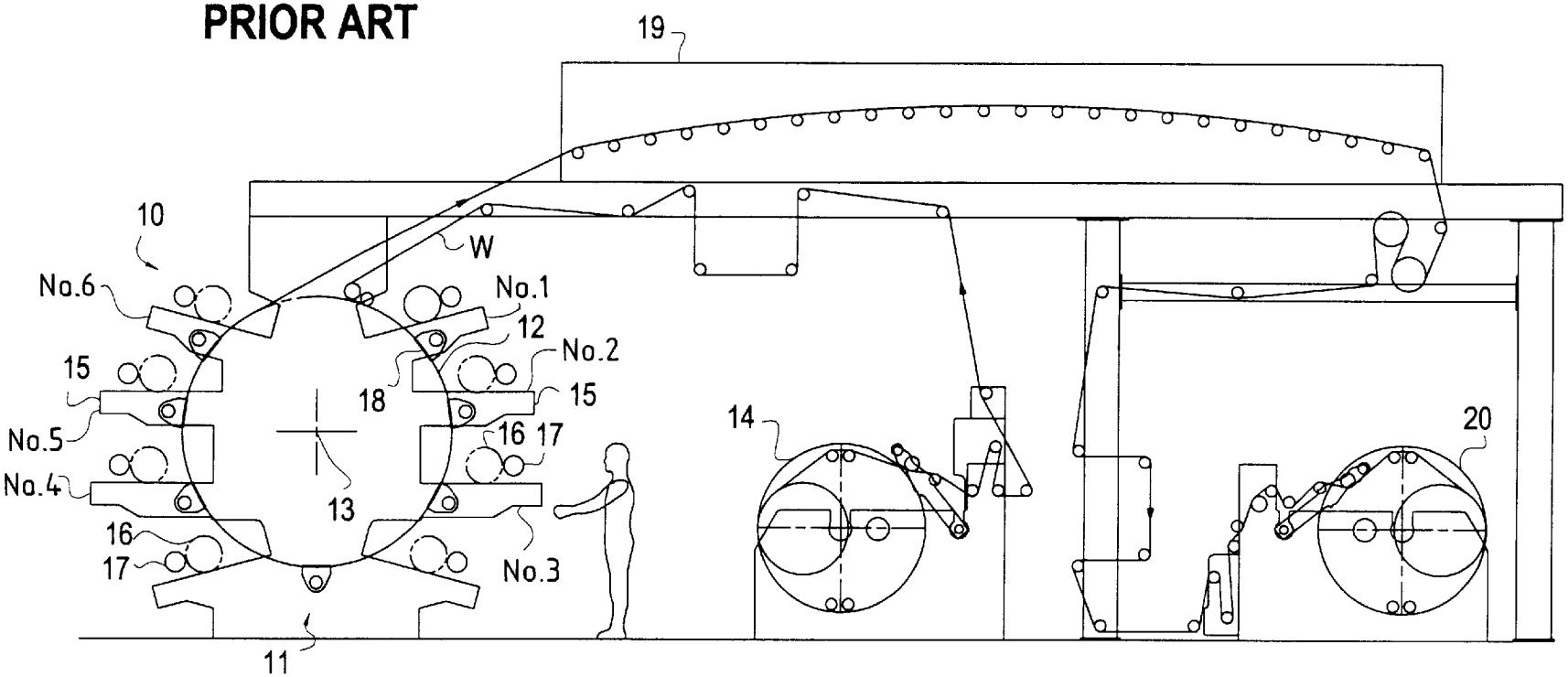
FIG.1 PRIOR ART
FIG. 1 is a front elevational view of a conventional flexographic printing press.

FIG. 1 illustrates a conventional prior art flexographic printing press 10 which includes a front frame 11, a rear frame (not shown), and a central impression(CI) drum or cylinder 12 which is rotatably mounted in the frames for rotation about its central axis 13. A web W is conveyed from an unwind stand 14 to the CI drum and is supported by the drum as the drum rotates.

A plurality of print decks or color decks 15 are mounted on the frames around the periphery of the CI drum 12. Each deck includes a plate roll 16 and an anilox roll 17 which are rotatably mounted on the deck. An ink fountain (not shown) on the deck supplies ink to the anilox roll, and the anilox roll transfers the ink to the plate roll. The plate roll prints an image on the web as the web is moved past the plate roll on the rotating CI drum. Between color dryers 18 are mounted between adjacent color decks, and the fully printed web is conveyed through a tunnel dryer 19 and rewound on rewind stand 20.

Figure 2:
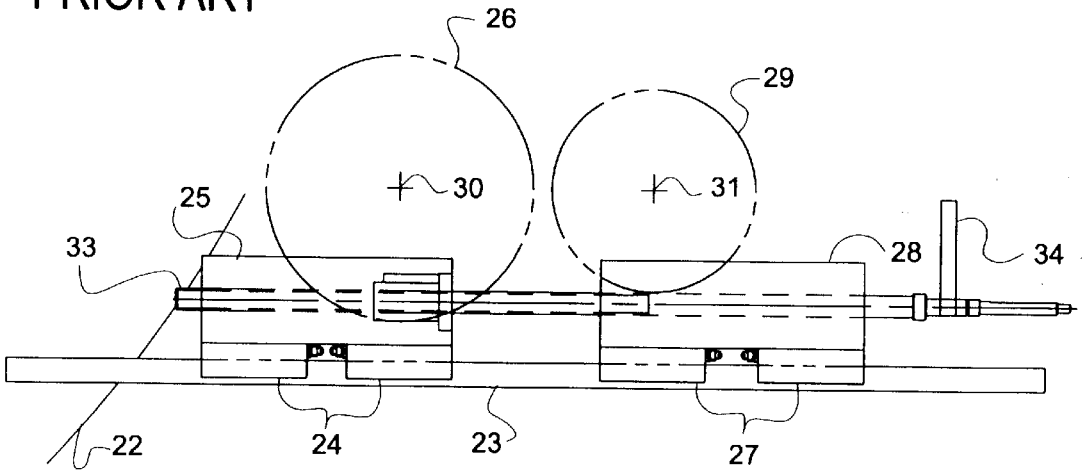
FIG.2 PRIOR ART
FIG. 2 is a fragmentary front elevational view of a prior art press deck for a flexographic press.

FIG. 2 illustrates a prior art deck 21 for a flexographic press which includes a CI drum 22. A linear rail 23 is mounted on each of the front and rear frames. Linear bearings 24 are mounted on the rails and support a bearing block 25 for a plate roll 26. Linear bearings 27 support a bearing block 28 for an anilox roll 29.

The plate roll includes journals (not shown) which are rotatably supported by bearings. The plate roll bearings are supported by the bearing block 25. The plate roll rotates about its axis or center 30.

Similarly, the anilox roll journals are rotatably supported by bearings which are supported by the bearing blocks 28 on each end of the anilox roll. The anilox roll rotates about its axis or center 31.

A ball screw 33 is rotatably mounted to the frame end plate 34 and threadedly engages the bearing block 25. A stepper motor on the frame end plate 34 rotates the ball screw 33 when it is desired to move the plate roll toward or away from the CI drum. The ball screw 33 passes through a clearance hole in the bearing block 28.

A ball screw 35, which is axially offset from the ball screw 33, is rotatably mounted to the frame end plate 34 and threadedly engages the bearing block 28. A stepper motor on the frame end plate 34 rotates the ball screw 35 when it is desired to move the anilox roll toward or away from the CI drum.

The plate and anilox bearing blocks 25 and 28 are mounted on top of the linear bearings and are moved along the linear rail by the ball screw. The disadvantage of this configuration is that there is a large vertical distance between the centers 30 and 31 of the plate and anilox rolls and the ball screws 33 and 35. During normal printing conditions, the ball screw and linear bearings will take all the printing force, but because of this vertical distance, a moment load is induced on the linear bearings (the plate and anilox rolls tend to pivot about a single linear bearing). This moment load is magnified from deck to deck by the position of the deck relative to the CI drum. Angled decks are worse in magnitude than the horizontal decks. The effect on an angled deck is that the print load is higher on the linear bearings than on the ball screw compared to the horizontal decks where the load is higher on the ball screw than on the linear bearings. The net result from this deck design is a lower deck stiffness (spring elements are in series) and a higher susceptibility to bounce during printing.

Figure 3:
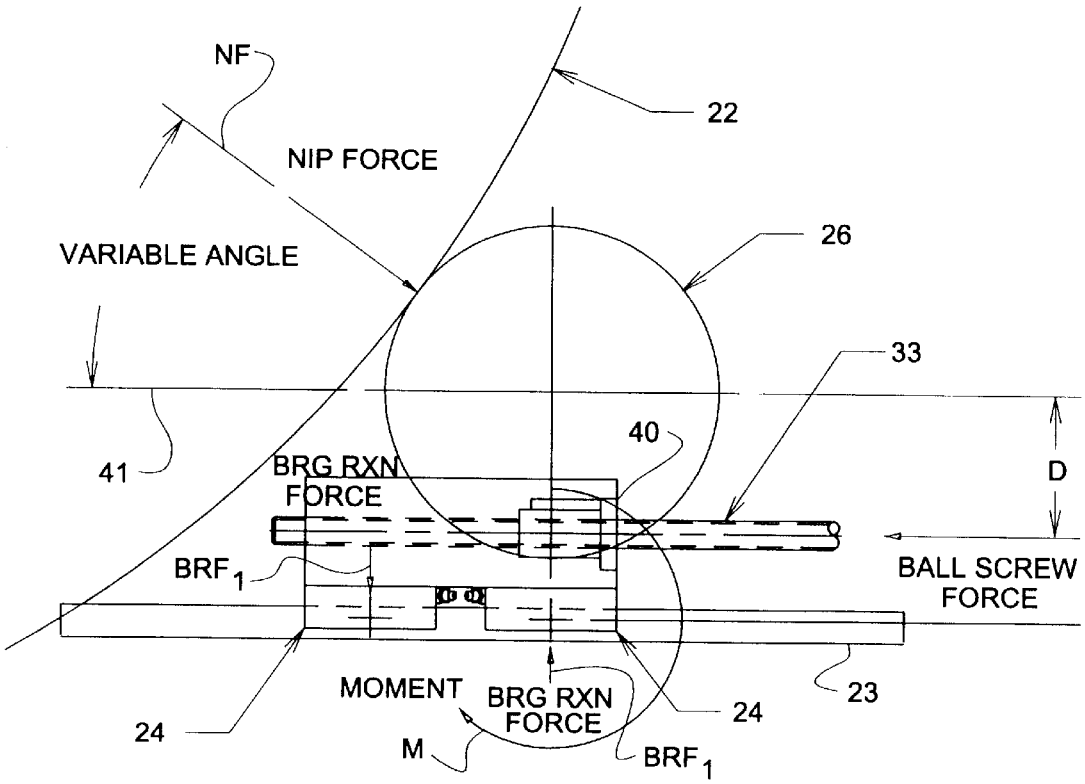
FIG.3 PRIOR ART
FIG. 3 is a force diagram which illustrates the forces which are imparted to the press deck of FIG. 2 by the flexographic printing process.

FIG. 3 illustrates the forces which are imparted to the plate roll. A nip force NF is applied to the plate roll 26 by the CI drum 22. The angle of the nip force relative to a line 41 which is parallel to the linear rails 23 is variable depending upon the location of the deck around the periphery of the CI drum. For deck Nos. 1, 2, 7, 8, the nip force points upward. For deck Nos. 3, 4, 5, 6, the nip force points downward.

The horizontal component of the nip force (the component parallel to the linear rails 23) coupled with the distance D produces a moment M about the ball nut 40. This movement is countered by the vertical stiffness component of the linear bearings 24. The greater the distance D, the greater the moment loading. The moment M is resisted by bearing reaction forces $BRF_1$ and $BRF_2$ which act on the linear bearings.

Figure 4:
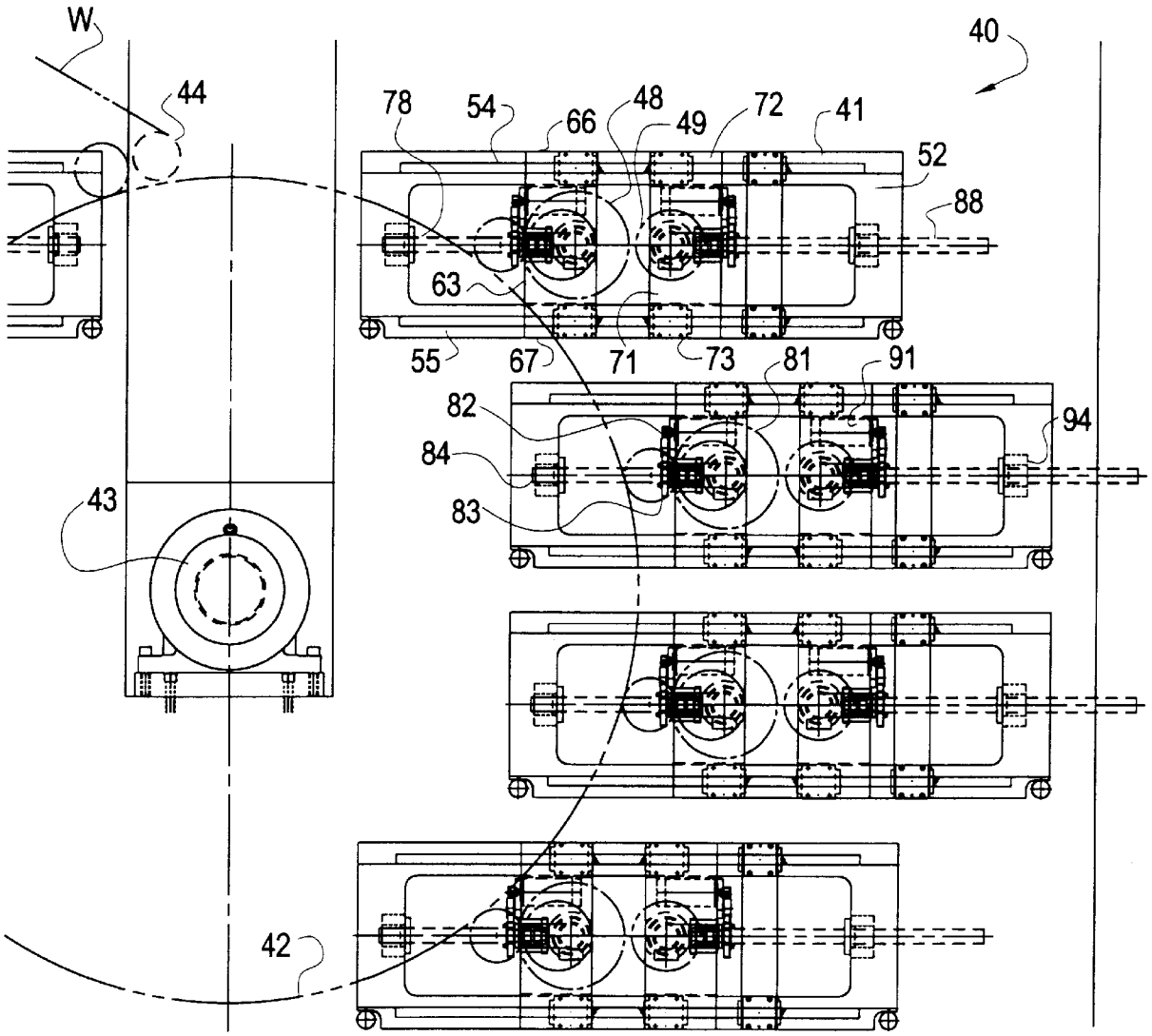
FIGS. 4 and 5 are fragmentary front elevational views of the right and left sides of a flexographic press formed in accordance with the invention.
Figure 5:
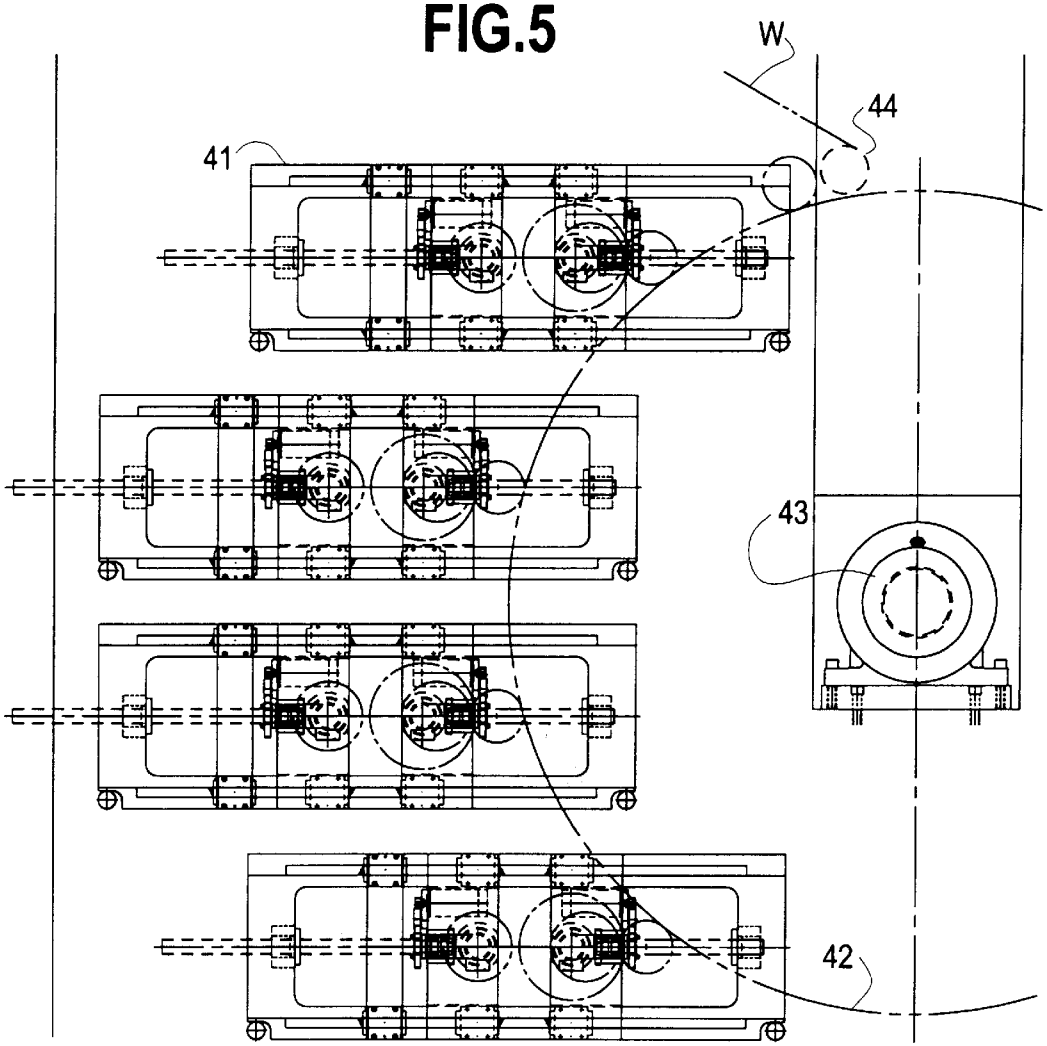

FIGS. 4 and 5 illustrate a flexographic press 40 with color decks 41 which are formed in accordance with the invention. The press 40 includes a conventional CI drum 42 which is rotatably mounted in bearings 43 which are supported on the front and back frames (not shown) of the press. A web W passes over laydown roll 44 and rotates with the CI drum.

Each of the color decks 41 includes a plate roll 48 and an anilox 49 which are supported by rectangular bearing support frames 52 which are mounted on the front and back frames of the press. Each bearing support frame 52 includes a pair of parallel spaced-apart upper and lower linear rails 54 and 55.

The plate and anilox rolls are illustrated in FIGS. 4 and 5 in their racked out positions in which the plate rolls are spaced from the surface of the CI drum and the anilox rolls are spaced from the plate rolls.

Figure 6:
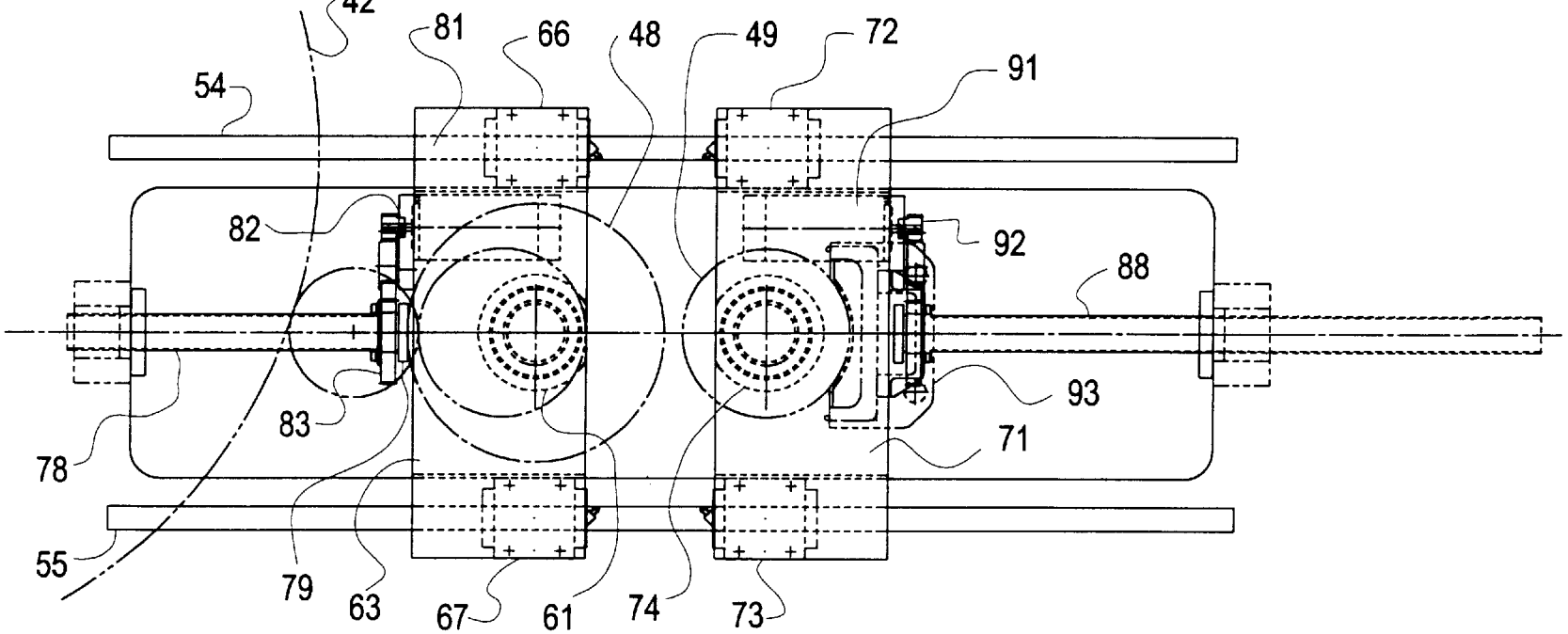
FIG. 6 is a fragmentary front elevational view of gearless press deck constructed in accordance with the invention.
Figure 7:
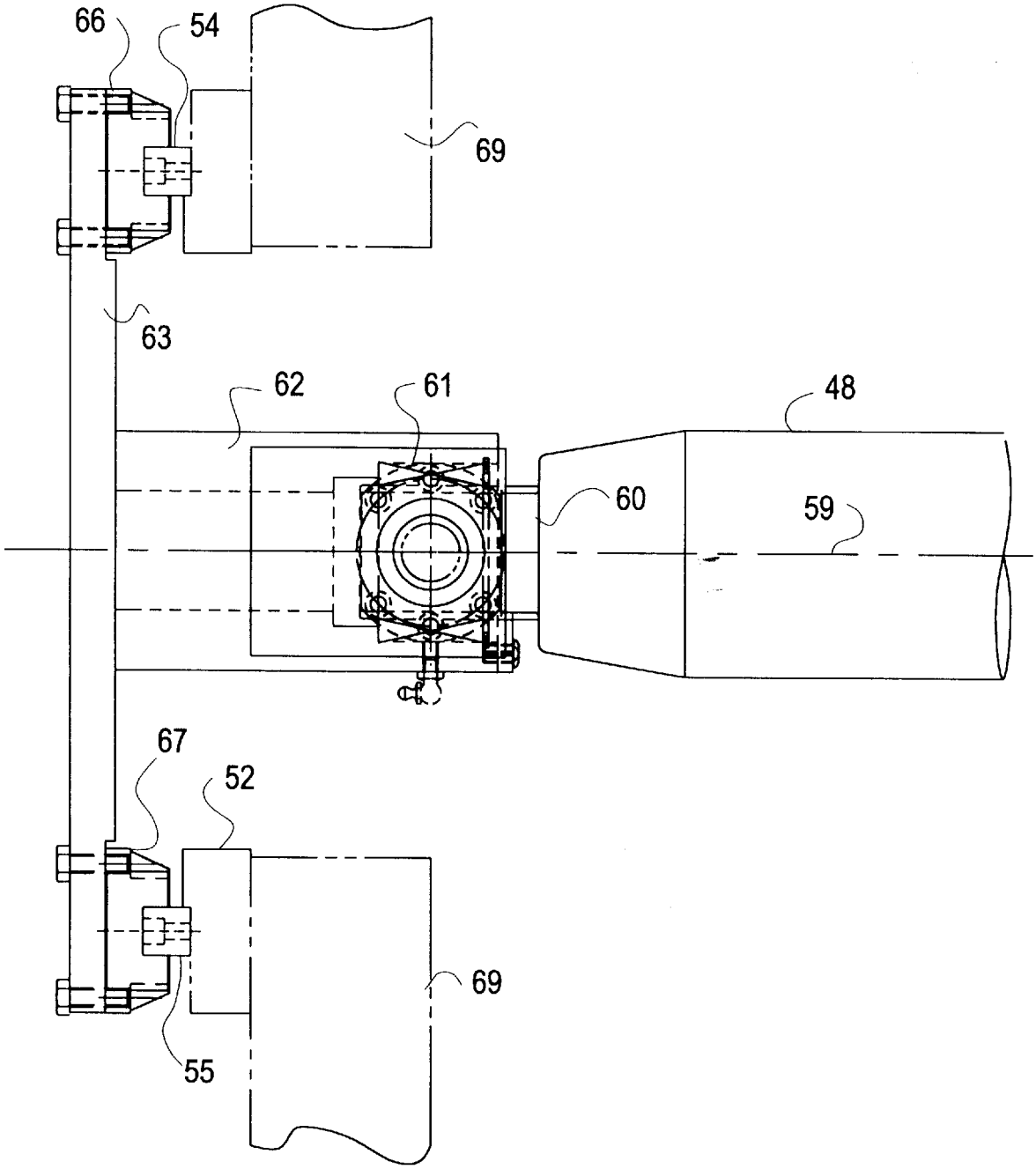
FIG. 7 is a fragmentary right end view of the deck of FIG. 6.

Referring to FIGS. 6 and 7, each plate roll 48 has a longitudinal axis 59 and includes a pair of end journals 60 which are rotatably supported in bearings 61. The plate bearings 61 are mounted in bearing blocks 62 which are attached to plate carriages 63. Upper and lower linear bearings 66 and 67 are attached to each of the plate carriages, and the upper and lower bearings are slidably mounted on the upper and lower linear rails 54 and 55 of the bearing support frames 52. FIG. 7 illustrates the attachment of the bearing support frames 52 to the front frame 69 of the press. The axis of the plate roll extends perpendicularly to the upper and lower rails 54 and 55.

The anilox roll 49 is similarly mounted for linear movement on the upper and lower rails 54 and 55. A pair of anilox carriages 71 (FIG. 6) are supported by upper and lower linear bearings 72 and 73. A bearing 74 is mounted on each anilox carriage and rotatably supports one of the journals of the anilox roll.

A ball screw 78 is rotatably mounted on the plate carriage 63 between the upper and lower rails 54 and 55 by a bushing 79. A stepper motor 81 is mounted on the plate carriage and rotates the ball screw through gears 82 and 83. The left end of the ball screw is threaded through a nut 84 (FIG. 4) which is mounted on the bearing support frame 52. As the ball screw 78 is rotated by the stepper motor 81, the plate carriages and the plate roll are moved along the upper and lower rails 54 and 55.

A second ball screw 88 is similarly rotatably mounted on the anilox carriage 71 between the rails 54 and 55. A stepper motor 91 rotates the ball screw 88 through gears 92 and 93. The right end of the ball screw 88 is threaded through nut 94 (FIG. 4) on the bearing support frame. As the ball screw 88 is rotated by the stepper motor 91, the anilox roll moves along the rails 54 and 55.

The ball screws 78 and 88 extend parallel to the upper and lower rails 54 and 55 and are preferably located midway between the rails. The line of action between the plate and anilox rolls, i.e., a line connecting the axes of rotation of the rolls, also extends parallel to the upper and lower rails. The axis of rotation of each of the ball screws 78 and 88 is substantially aligned with the line of action of the plate and anilox rolls and substantially intersects the axis of rotation of each roll. By "substantially aligned" and "substantially intersect" we mean that the axis of each ball screw is aligned with the line of action and intersects the axes of the rolls within the stacked tolerances of the normal manufacturing tolerances of the deck components.

Figure 8:
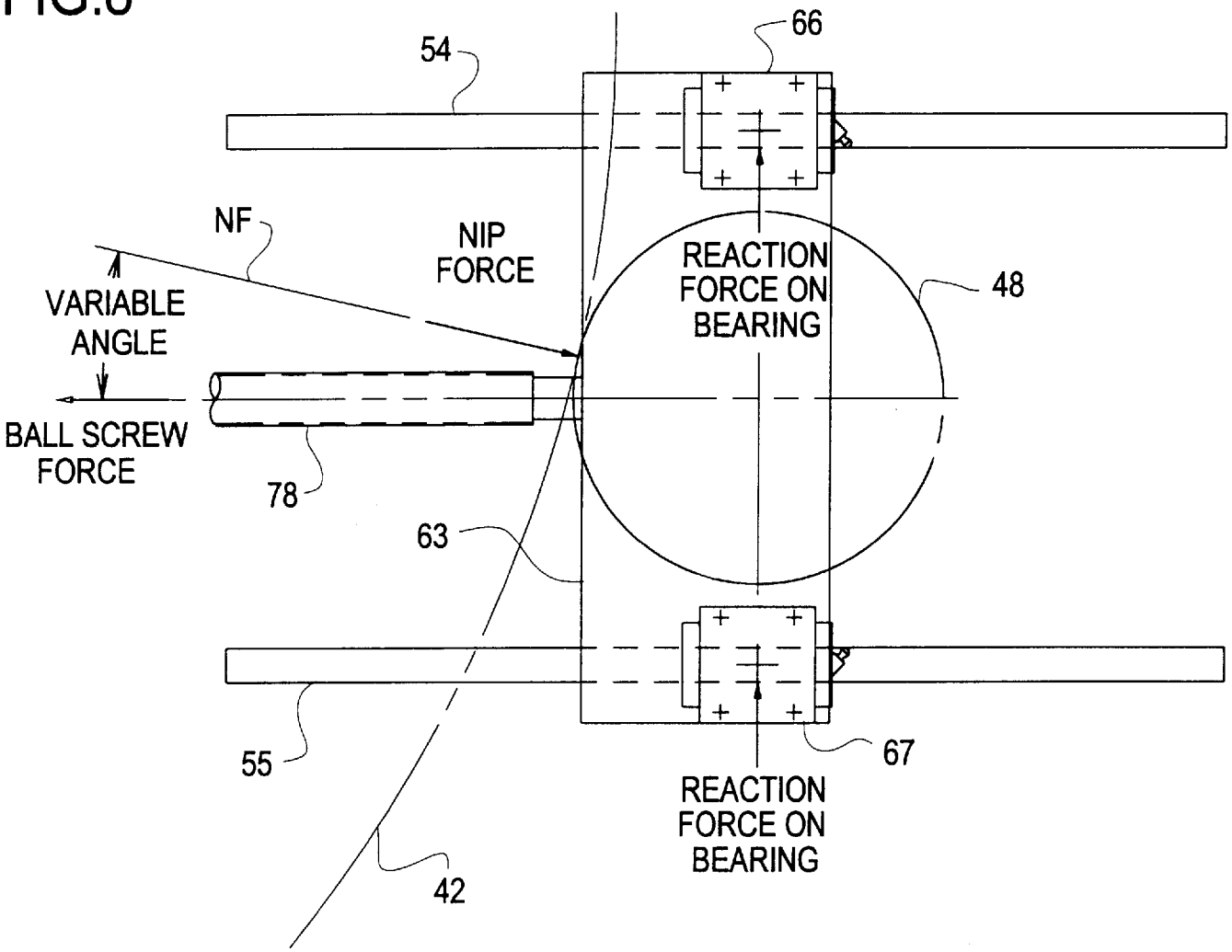
FIG. 8 is a force diagram which illustrates the forces which are imparted to the press deck of FIG. 6.

FIG. 8 illustrates the forces which are imparted to the inventive press deck during the printing process. The angle of the nip force NF relative to the plate roll 48 will vary. In deck Nos. 1, 2, 7, 8 the force pushes upwardly. In deck Nos. 3, 4, 5, 6, the force pushes downwardly.

The upper and lower linear bearings 66 and 67 need to provide resistance only in the vertical direction or in a direction perpendicular to the upper and lower rails 54 and 55. The ball screw 78 resists the horizontal component of the nip force and is sized accordingly. Moment loading is eliminated by substantially aligning the ball screw with the axis of rotation of the plate roll.

The new press deck design eliminates the moment loading condition of the prior art deck of FIG. 2 by aligning the ball screw with the axis of the plate roll. The ball screw is placed between the upper and lower rails and provides equal loading on the linear bearings during printing (rocking is eliminated). By placing linear bearings above and below the ball screw in line with the center of the roll, a much stiffer deck configuration is achieved.

The main advantage is that the deck can be configured in either angled or horizontal positions on the machine, providing that the line of action of the nip force extends through the axis of the plate roll. The print load is shared between the ball screw and the linear bearings on all decks except where the line of action between the CI drum and plate roll is purely horizontal. In that case, the ball screw is sized sufficiently (for all decks) to be able to handle column loading, and the linear rails only provide a means of guiding.

While in the foregoing specification a detailed description of a specific embodiment of the invention was set forth for the purpose of illustration, it will be understood that many of the details hereingiven may be varied considerably by those skilled in the art without departing from the spirit and scope of the invention.

We claim:

1. A printing press comprising:

a frame, a central impression cylinder having an axis and being rotatable mounted on the frame for rotation about its axis, the central impression cylinder having an outer surface for contacting a web to be printed, a first roll support assembly movably mounted on the frame for movement toward and away from the central impression cylinder, a first roll having an axis and being rotatably mounted on the first roll support assembly for rotation about its axis, the axis of the first roll extending parallel to the axis of the central impression cylinder, the first roll being engageable with a web on the central impression cylinder, a second roll support assembly movably mounted on the frame for movement toward and away from the first roll, a second roll having an axis and being rotatably mounted on the second roll support assembly for rotation about its axis, the axis of the second roll extending parallel to the axis of the first roll, the second roll being engageable with the first roll, a first rotatable screw extending in a first direction from the first roll support assembly to the frame for moving the first roll support assembly toward and away from the central impression cylinder, the first screw having an axis which substantially intersects the axes of the first and second rolls, a second rotatable screw extending in a second direction which is opposite to said first direction from the second roll support assembly to the frame for moving the second roll support assembly toward and away from the first roll, the second screw having an axis which substantially intersects the axes of the first and second rolls and which is aligned with the axis of the first screw, and upper and lower rails mounted on the frame, the axes of the first and second rolls extending perpendicularly to the rails and being positioned between the rails, the first and second roll support assemblies being movably mounted the rails, the first and second screws being positioned between the rails.

2. The press of claim 1 in which the axes of the first and second screws are parallel to the rails.

3. The press of claim 1 in which the first and second screws are about midway between the rails.

4. A printing press comprising:

a frame, a central impression cylinder having an axis and being rotatable mounted on the frame for rotation about its axis, the central impression cylinder having an outer surface for contacting a web to be printed, a first roll support assembly movably mounted on the frame for movement toward and away from the central impression cylinder, a first roll having an axis and being rotatably mounted on the first roll support assembly for rotation about its axis, the axis of the first roll extending parallel to the axis of the central impression cylinder, the first roll being engageable with a web on the central impression cylinder, a second roll support assembly movably mounted on the frame for movement toward and away from the first roll, a second roll having an axis and being rotatably mounted on the second roll support assembly for rotation about its axis, the axis of the second roll extending parallel to the axis of the first roll, the second roll being engageable with the first roll, a first rotatable screw extending between the first roll support assembly and the frame for moving the first roll support assembly toward and away from the central impression cylinder, the first screw having an axis which substantially intersects the axes of the first and second rolls, a second rotatable screw extending between the second roll support assembly and the frame for moving the second roll support assembly toward and away from the first roll, the second screw having an axis which substantially intersects the axes of the first and second rolls, first and second bearings for rotatably supporting the first and second rolls, respectively, and, a bearing support frame mounted on the frame and having upper and lower rails and front and rear ends, the bearing of each of the rolls being slidably supported by the upper and lower rails, the first screw extending between the first roll support assembly and the front of the bearing support frame and the second screw extending between the second roll support assembly and the rear of the bearing support frame.

5. A method of operating a printing press having a central impression cylinder with an axis of rotation comprising the steps of:

mounting a first roll adjacent the central impression, the first roll having an axis of rotation which extends parallel to the axis of the central impression cylinder, mounting a second roll adjacent the first roll so that the first roll is between the central impression cylinder and the second roll, the second roll having an axis of rotation which extends parallel to the axes of the central impression cylinder and the first roll, applying a translational force to the rolls in a direction which substantially intersects the axes of the first and second rolls, and slidably mounting the first and second rolls on upper and lower rails so that the axes of the first and second rolls extend perpendicularly to the rails and are positioned between the rails.

6. The method of claim 5 including the step of applying the translational force along a line which is positioned between the rails.

7. The method of claim 5 including the step of applying the translational force along a line which is positioned about midway between the rails.

* * * * *